United States Patent [19]

Wallman

[11] 4,041,593

[45] Aug. 16, 1977

[54] METHOD OF MAKING IMPELLERS FOR CROSS-FLOW FANS

[76] Inventor: Knut Olof Lennart Wallman, Fergas Aktiebolag Harstenagatan 2 S-582 21, Linkoping, Sweden

[21] Appl. No.: 674,297

[22] Filed: Apr. 6, 1976

Related U.S. Application Data

[60] Division of Ser. No. 502,097, Aug. 30, 1974, Pat. No. 3,970,411, which is a continuation-in-part of Ser. No. 347,340, April 2, 1973, abandoned.

[51] Int. Cl.[2] ..... B23P 15/00; B21D 53/00; B23P 11/00

[52] U.S. Cl. ..... 29/156.8 CF; 113/116 D

[58] Field of Search ..... 29/156.8 CF; 113/116 D; 416/178, 180, 184, 187

[56] References Cited

U.S. PATENT DOCUMENTS

| | | | |
|---|---|---|---|
| 1,657,758 | 1/1928 | Lum | 416/184 |
| 2,496,179 | 1/1950 | Schwarz | 29/156.8 CF |
| 3,156,408 | 11/1964 | Whitenack, Jr. | 416/178 |
| 3,262,637 | 7/1966 | Sprouse et al. | 29/156.8 CF |
| 3,385,511 | 5/1968 | Wentling | 416/178 |
| 3,816,023 | 6/1974 | Shaver | 416/184 |
| 3,854,844 | 12/1974 | Ranz | 416/184 |

FOREIGN PATENT DOCUMENTS

| | | | |
|---|---|---|---|
| 723,025 | 12/1965 | Canada | 416/187 |
| 23,608 | 11/1949 | Finland | 416/187 |
| 1,399,764 | 4/1965 | France | 416/184 |
| 469,970 | 8/1937 | United Kingdom | 416/187 |

*Primary Examiner*—C.W. Lanham
*Assistant Examiner*—Daniel C. Crane
*Attorney, Agent, or Firm*—Ira Milton Jones & Associates

[57] ABSTRACT

A rotor for a cross-flow blower has narrow elongated blades fixed in slots in the peripheral portions of a plurality of parallel discs spaced from one another along the rotor axis. The blades have curved cross sections, and each has creased portions received in the slots in the discs. The creased portions are formed to have supporting and stabilizing engagement with the opposite side edges of the slots and with opposite face portions of the discs adjacent to the slots.

10 Claims, 13 Drawing Figures

FIG 7
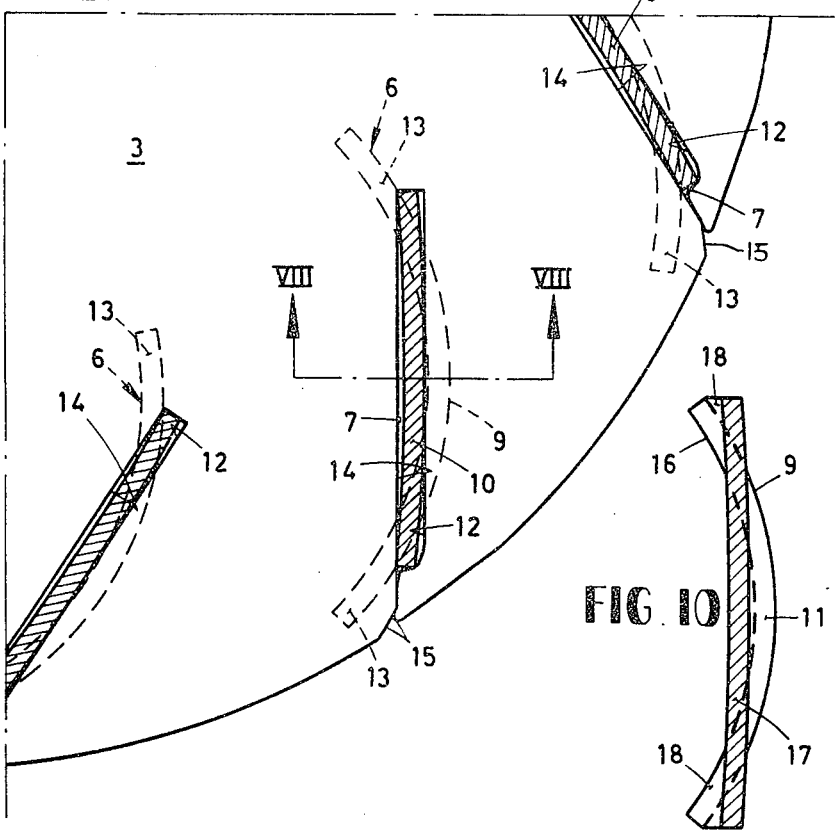
FIG. 10
FIG 8
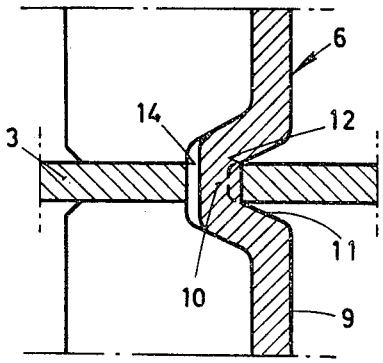
FIG 9
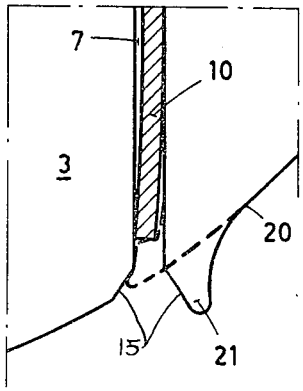

METHOD OF MAKING IMPELLERS FOR CROSS-FLOW FANS

This application is a division of my copending application Ser. No. 502,097, filed Aug. 30, 1974, now U.S. Pat. No. 3,970,411, which is, in turn, a continuation-in-part of my then-copending (now abandoned) application Ser. No. 347,340, filed Apr. 2, 1973, entitled "Device at Impellers for Cross-Flow Fans."

This invention relates to blowers, and has more particular reference to structural improvements in the rotors of blowers generally and especially those of the cross-flow type.

A typical rotor of this type comprises two or more parallel sheet metal discs of circular outline spaced apart axially of the rotor axis and having elongated narrow blades of curved cross section secured in equispaced slots in their peripheral portions. Inasmuch as rotors such as these usually have a length several times their diameter, it was difficult in the past to achieve a torsionally rigid structure due to inherent weaknesses in the joints between the blades and the rotor discs.

Heretofore there have been a number of proposals for achieving the desired rigidity at the blade joints which, however, were either difficult to carry into practice or added to the cost of rotor production without necessarily resulting in the desired firm attachment of the blades to the rotor discs. One such proposal, for example, involved the formation of curved slots in the peripheral portions of the rotor discs to match the cross sectional curvature of the blades. To facilitate edgewise insertion of the blades into the curved slots, the mouths of the latter were made wider, and securement of the blades against outward displacement from their slots was accomplished by inwardly deforming circular edge portions of the discs, adjoining their slots, to restrict the mouths of the slots.

Because of the curvature of the blades and the slots intended for their reception, the step of blade insertion presented a serious assembly problem that was extremely difficult to overcome by production methods of manufacture. Moreover, by the aforesaid proposal, the blades could not be firmly secured against lengthwise motion relative to the rotor discs due to the fact that the width of the slots in the discs always had to be made somewhat greater than the blade thickness to facilitate insertion of the blades thereinto.

With the above in mind, the present invention has for its objects the provision of a method of making a rotor or impeller for blowers that is appreciably stronger and more durable than prior devices of this type and which method, moreover, is simpler and less costly than prior assembly methods and lends itself admirably to mechanization.

Another object of the invention is to provide a simple method of making a blower rotor which can be practiced with the use of inexpensive equipment and which quickly produces a very sturdy rotor.

It is also an object of the invention to provide a method of making a blower rotor assembly of rotor discs and blades that is sufficiently secure to withstand handling immediately after the blades are assembled with the discs and even before a final operation by which the blades and discs are permanently locked together.

With these observations and objectives in mind, the manner in which the invention achieves its purpose will be appreciated from the following description and the accompanying drawings, which exemplify the invention, it being understood that changes may be made in the precise method of practicing the invention disclosed herein without departing from the essentials of the invention set forth in the appended claims.

The accompanying drawings illustrate several complete examples of embodiments of the invention constructed according to the best modes so far devised for the practical application of the principles thereof, and in which:

FIG. 7 is an enlarged fragmentary cross sectional view illustrating how the blades are secured in the slots of the rotor discs;

FIG. 8 is an enlarged cross sectional view taken through one of the blades in FIG. 7, along the line 8—8 therein;

FIG. 9 is a fragmentary view of a portion of the rotor seen in FIG. 7 and showing how the rotor discs are formed to facilitate securement of the blades in their slots;

FIG. 10 is a cross sectional view similar to FIG. 5 through a blade of slightly modified construction;

Figure 1:
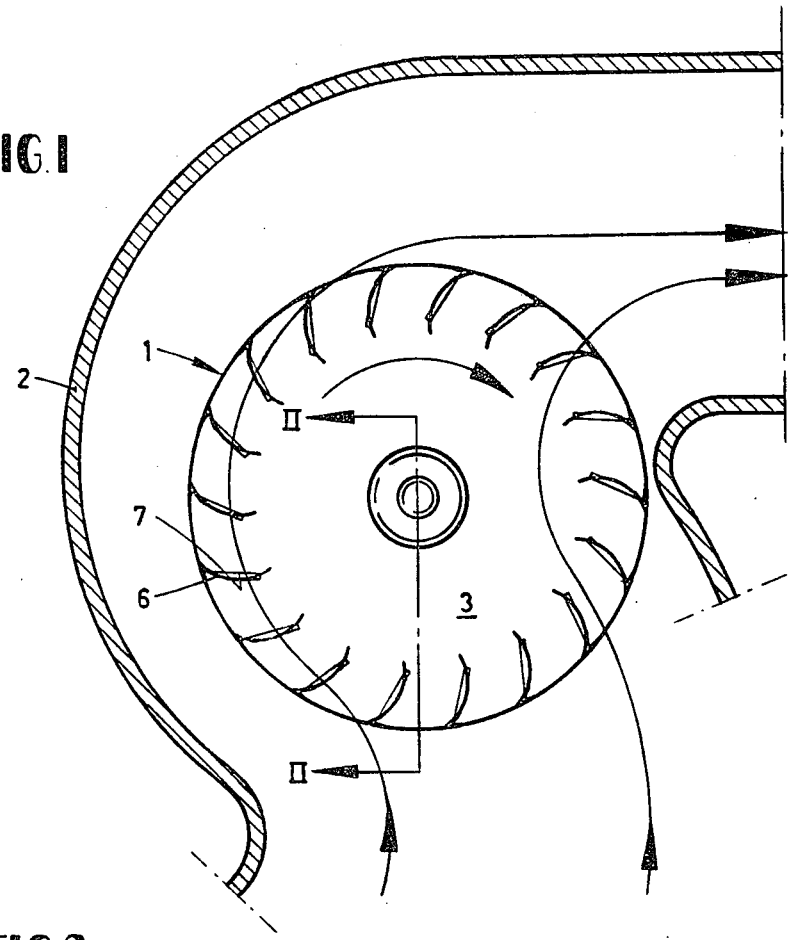
FIG. 1 is an end view of a rotor made according to the method of this invention, shown in position in the housing of a cross-flow blower installation.
Figure 2:
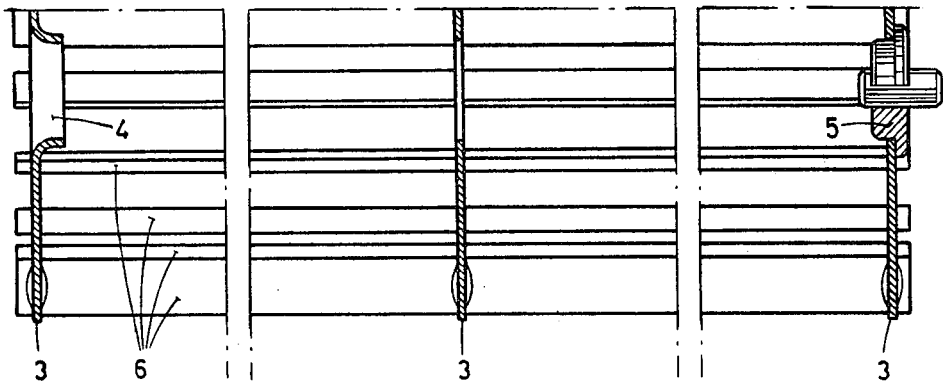
FIG. 2 is a longitudinal sectional view taken on the line 2—2 of FIG. 1.

Referring now to the accompanying drawings, the numeral 1 generally designates an impeller or rotor of the type which is particularly well but not exclusively suited for use in a cross-flow fan or blower, the rotor being mounted in the casing 2 of the blower as seen in FIG. 1. The casing has been shown as having a radially oriented inlet 22 near its bottom, and a radially oriented outlet 23 at one side, located 90° or slightly less from the inlet in the direction of rotor rotation. As shown by the arrow in FIG. 1, the rotor is rotated in the clockwise direction to draw air into its inlet 22 and to force such air out of its outlet 23.

As is customary, the impeller or rotor 1 comprises a number of flat, radially oriented circular discs 3 spaced from one another along the rotor axis. The two discs at the opposite axial ends of the rotor are provided with an annular coupling member and a hub 5, respectively, which together define the axis about which the rotor rotates. The rotor further comprises a number of identical elongated blades 6 which extend for the full length of the rotor and are parallel to its axis. The blades are fixedly mounted in circumferentially equispaced slots 7 which open to the peripheral portions of the discs. All of these slots are oriented to lie in identical positions relative to the rotor axis.

Each of the blades 6 comprises a sheet metal stamping having a long rectangular shape and an arcuately curved cross section, the curvature of the cross-section profile being uniform all along the length of the blade except at the lengthwise spaced zones where the blade is secured to the rotor discs. The blades are mounted in the slots 7 of the rotor discs with their concave sides facing in the direction of rotor rotation.

According to this invention, each blade is formed with a plurality of creases 8 which extend transversely to the length of the blade and are in the nature of indentations in its convex side 9. These creases define substantially channel-shaped portions on the blade with the back of each channel providing a substantially narrow strip 10 and opposite flanges 11 which extend to one side of the back strip. The back strips 10 are receivable in the slots 7 to mount the blades on the rotor 8. The number of creases, of course, corresponds to the number of axially oriented discs of which the rotor is comprised — three in the present case.

Each such back or mounting strip 10 is of rectangular shape with its longer dimension cross-wise of the blade. It is quite important, however, that the narrow dimension of the mounting strips, measured lengthwise of the blade, closely correspond to the thickness of the rotor discs.

All of the rotor discs can have the same thickness dimension; and all of the mounting strips 10 are depressed the same amount into the convex sides of their blades. Hence, in a rotor having three axially spaced blade carrying discs, each blade will be creased to have one mounting strip 10 at its midportion, at the location of the center disc on the rotor, and to have similar mounting strips at each end portion, at the location of the two end discs of the rotor.

It is also of considerable importance that each of the back or mounting strips 10 be sharply defined along the longer edges thereof which extend crosswise of the blade. This is to say that it is desirable to have the smallest possible radius where the longer edges of the strip meet the flanges 11 which flank the strip 10 at the convex side of the blade (see FIG. 8). As shown, the flanges 11 slope away from the opposite faces of the discs adjacent to the trailing edges 12 of the slots 7.

As seen best in FIGS. 7 and 8, a substantial part of the trailing edge 12 of each disc slot 7 is tightly fitted into the bottom of each channel shaped crease. This is especially desirable in that it minimizes axial movement of the blade relative to the rotor discs. In effect, therefore, the flanges 11 define opposing abutments between which the disc is confined.

Figure 3:
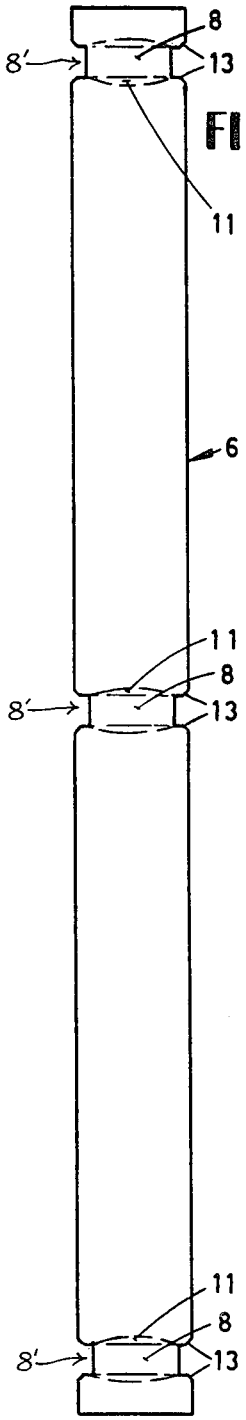
FIGS. 3 and 4 show one of the impeller blades in plan and edge view, respectively.

FIG. 3 illustrates that the mounting strips 10 need not necessarily extend completely across the width of the blades. They can terminate substantially equal distances short of the longitudinal edges of the blades, to have their ends define the bottoms of notches or recesses 8' cut in the blade edges. These notches can be produced by a punching operation, preferably before creasing the blades. The opposite side edges 13 of these notches must be parallel to one another and perpendicular to the length of the blades, the opposing edges 13 of each notch may be said to constitute continuations of the opposite edges of the mounting strips at the bottoms of the sloping side walls 11 flanking the same. Thus, the edges 13 of the notches will tightly embrace portions of the disc adjoining their slots when the blades are in position on the rotor, and they provide further opposing abutments that prevent endwise displacement of each blade relative to the discs.

Also according to this invention, the slots 7 in the rotor discs are made of uniform width, such as to snugly receive the mounting strips 10 therein. As a result, the mounting strips will be more or less wedged in the slots, and the sloping wall portions 11 of the creases 8 at the convex side of the blades will substantially embrace those portions of the discs adjoining the edges 12 of the slots when the mounting strips are inserted edgewise thereinto during assembly of the blades on the rotor.

It is particularly important to note that an exceptional degree of stability in the joints between the blades and the rotor discs can be achieved, for example, by forming each of the mounting strips 10 with a slight curvature along its length, to give it a concave side of large radius at the concave side of the blade and a corresponding convex side at the convex side of the blade. The slots 7, in that case, should have straight opposing edges 12 and 14 and a width which is only slightly greater than the thickness of the mounting strip received therein.

This not only facilitates edgewise insertion of the blade mounting strips into the rotor disc slots, but it also assures the desired clamping or wedging action of the strips in their slots due to engagement of the slot edges 12 with the center portions of the mounting strips and the opposite edges of the slots with the ends of the mounting strips. It will be appreciated, of course, that the same clamping effect can be achieved when the mounting strips are made flat and the slots are given a slight curvature.

In either of these cases, or in any of the obvious alternative arrangements, it will be apparent that when the blade is received in a slot, flexing bias along the strip 10 forces parts of each face of the strip into snug engagement with parts of one long edge of the slot, by reason of reaction of the opposite face of the strip against the opposite slot edge. In effect therefore, the opposite faces of the strip 10 comprise one set of friction surfaces, and the opposite longitudinal edges of the slot provide another set of friction surfaces, each of which can oppose one of the friction surfaces of the first set; and each friction surface of one set is maintained engaged with its opposing friction surface of the other set under the restoring force of the flexed strip 10, to thus frictionally retain the blade in the slot. Note that for ease of insertion of the blade, one set of friction surfaces is substantially straight and parallel.

If desired, each of the slots 7 may be provided with an entering bevel 15 or an equivalent widening at its mouth, to facilitate edgewise assembly of the blades thereinto. In any case, the mouth of each slot is at least as wide as the narrowest part of the slot that is inwardly thereof.

The lateral stability which characterizes the blade joint described thus far is enhanced by the confinement of the discs between opposing edges 13 on the blades at each crease. This, however, requires that the blade be notched to provide the edges 13 thereon. In cases where greater blade strength is imperative a corresponding stabilizing effect can be achieved without, however, subjecting the blades to any weakening of their cross sections due to the recesses or notches in their opposite longitudinal edges. FIG. 10, for example, reveals how such notches can be eliminated by forming the mounting strips 17 so that they extend across the full width of the blades.

In this case, the blade is creased or indented in such a way that the medial portion of its mounting strip 17 is offset to the concave side of the blade while its end portions occupy positions at the convex side of the blade. This produces two opposing abutments or supporting walls 18 on the blade, formed adjacent to each end of each mounting strip 17, at the convex side of the blade, which enbrace and have supporting engagement with opposite face portions of the rotor disc adjoining the slots therein. Here also, the mounting strips should have a narrow dimension which matches the thickness of the rotor disc 3 to assure that portions of the latter will be tightly embraced by portions of the blade at each crease thereof. In addition, the mounting strips should also be made to have engagement with both edges of the slots in which they are received when the blades are assembled on the rotor.

Figure 4:
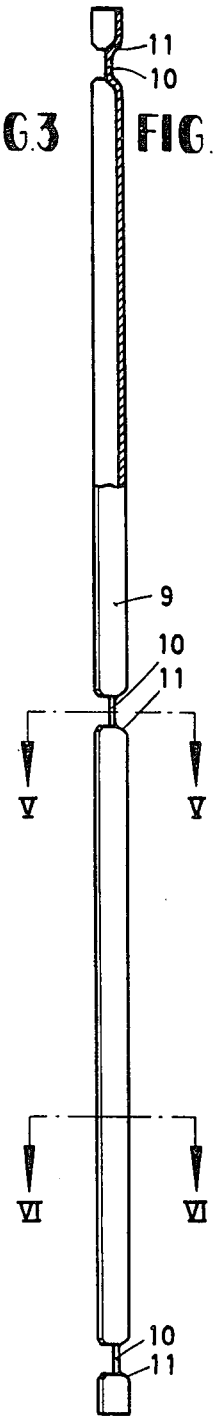
Figure 5:
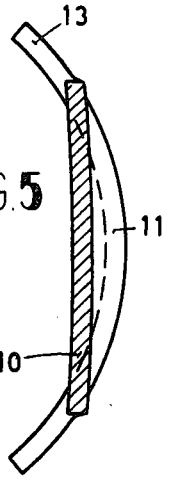
FIG. 5 is an enlarged cross section of the blade taken on the line 5—5 in FIG. 4.
Figure 6:
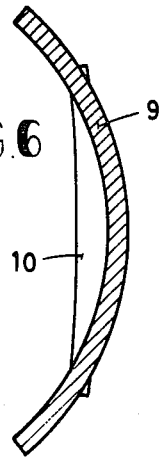
FIG. 6 is an enlarged cross section of the blade taken on the line 6—6 in FIG. 4.

Because of the absence of the notches in its longitudinal edges, the blade of FIG. 10 will be considerably stronger than that of FIGS. 3 and 4, and will obtain support from the rotor discs along the whole width of the blade. The blade construction of FIG. 10 is also advantageous in that it produces joints which give it better resistance to bending under the forces imposed thereon by air pressure during operation of the blower. A further significant advantage of the blade construction shown in FIG. 10 is that it is considerably easier to manufacture than the first described blade, in which the opposing edges 13 of the notches in the longitudinal edges of the blades must be quite accurately located in order to assure that the disc will be embraced thereby.

Figure 11:
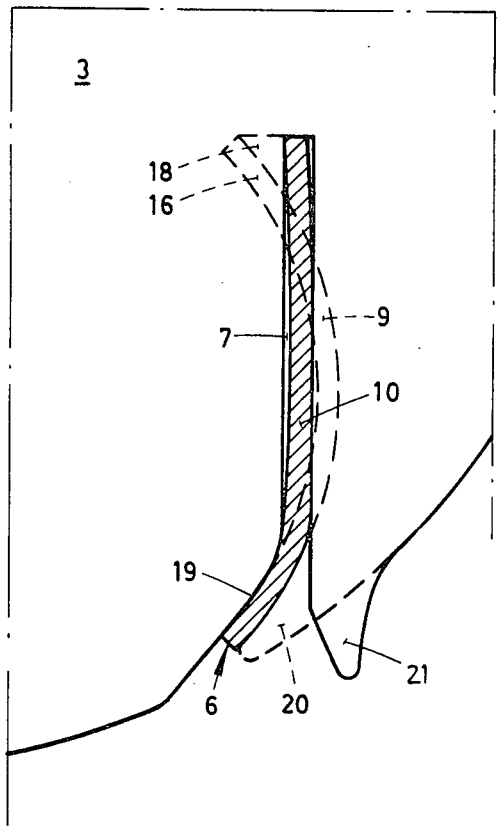
FIG. 11 is a view similar to FIG. 9 showing how another form of blade can be secured in the slots of the rotor discs.

The blade shown in FIG. 11 differs from that of FIG. 10 in that an outer part of each mounting strip 10 thereof is not deformed by the creasing operation but has the same curvature as the uncreased portion of the blade. For that reason, the outer portion of the leading edge of each slot 7 is cut to have a convexly curved edge portion 19 which nests in the concave outer portion of the mounting strip received in said slot.

It will be apparent that a rotor of this invention is easily assembled by fixing the required number of discs 3 in coaxial properly spaced relation to one another, with their slots aligned, and then edgewise inserting the blades into their respective slots in the rotor discs. It will also be apparent that immediately after such insertion of the blades the assembly comprising the discs and blades will be sturdy enough to withstand a reasonable amount of handling, owing to the relative snugness and stability of the joints that connect the blades and the discs. Thus the blades can be inserted into the rotor discs at one work station, and the assembly can then be safely transported to another work station at which the blades are permanently locked into the rotor slots.

One way of permanently anchoring the blades in the slots, to hold them firmly against the inner ends of the slots, is to provide the discs with the tabs 21 (see FIG. 9) that project outwardly beyond the periphery 20 of the discs at the rear or trailing edges of the slots 7 therein. After the blades are in proper positions in their slots, engaging the inner ends thereof, the projections 21 are deformed edgewise forwardly and inwardly to close the mouths of the slots as shown by the broken line in FIG. 9. In the case of a blade having the configuration illustrated in FIG. 11, the edgewise forward and inward displacement of each tab 21 brings it into engagement with the convex outer face portion of the mounting strip of the blade to clamp that portion of the mounting strip against the convexly curved outer leading edge portion of its slot.

By suitably proportioning the projecting tabs 21, it is possible to secure the blades in their slots and still obtain a substantially uniformly circular contour for the discs.

Figure 12:
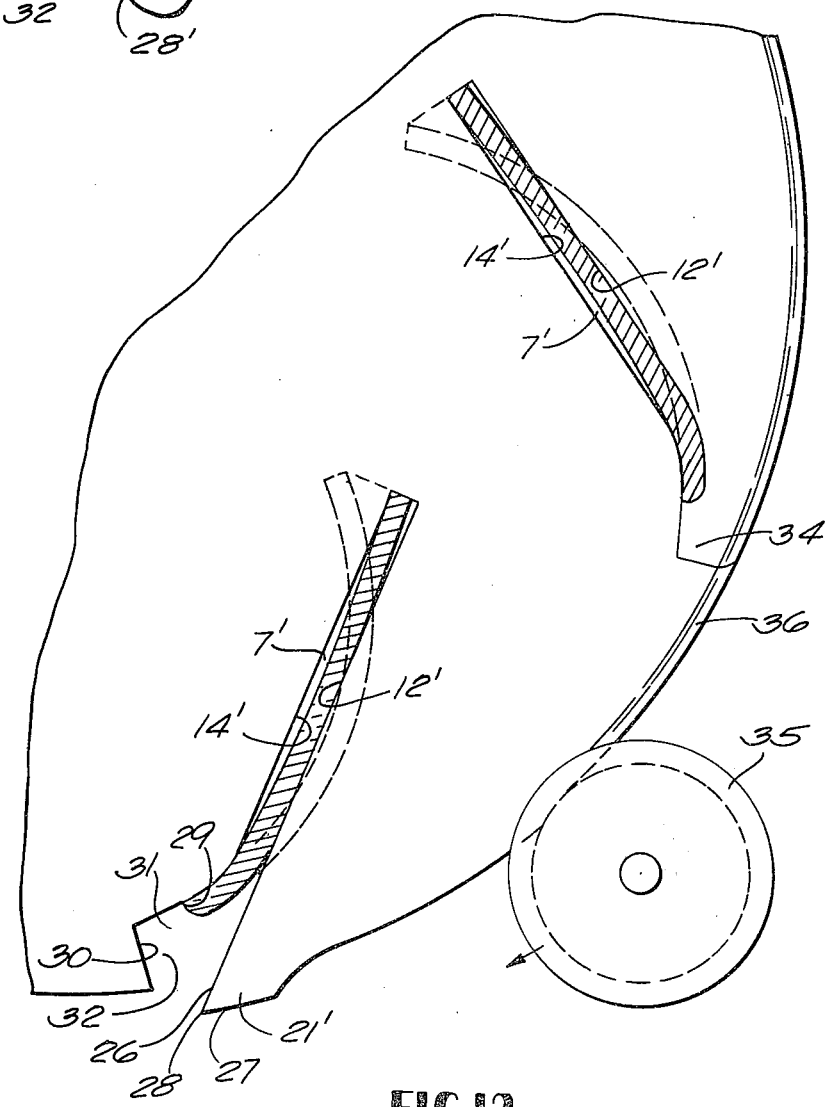
FIG. 12 is a view generally similar to FIG. 11 but illustrating a modified form of rotor disc to which is secured a blade like that shown in FIG. 11.

In the embodiment of the invention illustrated in FIG. 12, the rotor disc is so formed, with respect to the configuration of its slots 7' and tabs 21', that each deformed tab is securely locked into place by its engagement with another part of the disc. In this case again, each slot 7' has a substantially straight leading edge 14' and a substantially straight trailing edge 12', and these opposing edges, which extend outwardly from the inner end of the slot, are spaced apart by a uniform distance along their lengths.

The tab 21' that is adjacent to each slot has a straight edge 26 that is in a continuous straight line with the trailing edge 12' of the slot and has a radially outer edge 27 which joins said tab edge 26 at an exterior corner 28. The straight leading edge 14' of the slot extends outwardly from the inner end of the slot along most of the length of the slot but terminates short of the periphery of the disc. A pair of substantially straight edge portions 29 and 30 extend between the straight leading edge 14' and the disc periphery, meeting one another at a sharp interior corner 31 and thus defining a bay 32 that opens toward the trailing edge 12' of the slot. Note that the concave face of the curved portion of the mounting strip 10 of the blade closely overlies the edge portion 29, which therefore joins the straight trailing edge 14' around a curve that fits the curvature of this portion of the strip. Preferably the mouth of the slot is slightly wider than the distance between the straight edges 12' and 14', and hence no part of the slot is narrower than the distance between those edges.

When the tab 21' is edgewise deformed, the exterior corner or nose thereon that is defined by its edges 26 and 27 is received in the bay 32, as indicated at 34, and its straight circumferentially facing edge 26 is brought into engagement along its length against the convex surface of the curved part of the strip 10 of the blade, thus very securely holding the blade in the slot. Furthermore, the bay-defining edge 30 faces obliquely into the slot, and it thus locks the deformed nose 34 of the tab against radially outward displacement.

Figure 13:
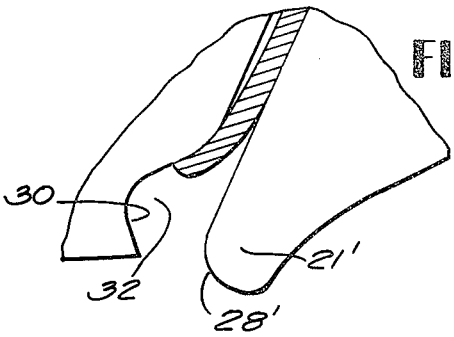
FIG. 13 is a view generally similar to the left hand portion of FIG. 12 but illustrating a further modified form of the rotor disc.

FIG. 13 illustrates a modified embodiment of the invention which is similar to FIG. 12 with respect to features of the blade and essential features of the disc, but wherein the disc has a somewhat different initial shape with respect to its radially projecting edgewise deformable tabs 21 and the bay 32 in which each tab is received when it is deformed. In the FIG. 13 embodiment each tab 21' has a rounded nose 28', instead of the sharp corner 28, and the bay 32 is correspondingly concavely rounded although still having an edge portion 30 that extends inwardly of the slot from the disc periphery and faces obliquely into the slot.

The edgewise deformation of the tabs 21' can be accomplished by means of a roller 35 that edgewise compresses the peripheral portion of the disc, all around the same, to form a small circumferential bead 36 around it. The rolling operation is performed in the circumferential direction to edgewise deform the tab before deforming the portion of the disc periphery at the opposite side of the slot from the tab, and thus the bead formed adjacent to the bay-defining edge 30 further serves to lock the nose 34 of the tab into the bay.

From the foregoing description, together with the accompanying drawings, it will be readily apparent to those skilled in the art that the rotor of this invention is characterized by blades which are exceptionally well anchored to the rotor discs to achieve a degree of rigidity in the rotor which was heretofore unattainable.

Those skilled in the art will appreciate that the invention can be embodied in forms other than as herein disclosed for purposes of illustration.

The invention is defined by the following claims:

I claim:

1. The method of making a blower rotor of the type that comprises at least one sheet metal disc and a plurality of elongated blades which are secured to the disc at circumferentially spaced intervals around it and extend lengthwise parallel to the axis of the disc, said method being characterized by:

A. forming each of said blades with a substantial curvature across its width that is uniform along most of the length of the blade, but with the blade having, at a location at which it is to engage a disc, an indentation deformed within the blade and that
   1. is elongated transversely of the blade,
   2. has a curvature along its length which is substantially less than said curvature of the remainder of the blade.
   3. has a width (as measured lengthwise of the blade) that is substantially equal to the thickness of said disc, and
   4. is in flatwise offset relation to adjacent portions of the blade that have the first mentioned curvature;

B. forming the disc with a plurality of circumferentially spaced slots that open unrestrictedly to its periphery, one slot for each blade, each of said slots defining a pair of opposite edges which have a slightly different curvature along their lengths than said curvature of the indentation in the blade, said edges being spaced apart by a substantially uniform distance along their lengths but by a projected distance which is slightly less than the projected thickness of the blade through the indentation; and C. inserting the indentation portion of each blade into a slot in the disc by forcing the blade edgewise thereinto, the shape and spacing of the edges of each slot being such in relation to the curvature and thickness of the indentation in the blade that each indentation is flexed along its length when received in its slot so that the blade is thus held against displacement relative to the disc.

2. The method of claim 1, further characterized by:

D. after each blade has been inserted into its slot in the disc, deforming a peripheral portion of the disc adjacent to the mouth of the slot, in a direction to close the mouth of the slot, to thus permanently secure the blade to the disc.

3. The method of making a blower rotor of the type comprising at least one sheet metal disc and a plurality of elongated blades which are secured to the disc at circumferentially spaced intervals around it and extend lengthwise parallel to its axis, said method comprising:

A. forming the disc with
   1. a plurality of circumferentially equispaced slots, one for each blade, each said slot having
      a. a substantially straight longer edge which faces obliquely in one circumferential and one radial direction and which extends from the inner end of the slot to the periphery of the disc,
      b. a substantially straight shorter edge which opposes said longer edge and which is spaced therefrom by a uniform distance along its length, said shorter edge extending from the inner end of the slot but terminating a distance inwardly of the periphery of the disc, and
      c. a pair of other edge portions which together extend from said shorter edge to the periphery of the disc, said pair of other edge portions meeting at an interior corner to define a bay which is just inside the mouth of the slot, and the one of said shorter edge portions that is adjacent to the periphery facing obliquely into the slot, and
   2. a plurality of radially outwardly projecting tabs on the periphery of the disc, one such tab adjacent to each slot, each such tab having a straight edge portion which is continuous with said longer edge of its adjacent slot and having a radially outermost edge portion which intersects its said straight edge portion at an exterior corner to define a nose on the tab;

B. forming each blade with
   1. a substantial curvature across its width that is uniform along most of the length of the blade,
   2. a pair of opposing abutments at the location along the length of the blade at which the blade is to engage said disc, the abutments of said pair facing lengthwise of the blade and being spaced apart by a distance such that they can closely engage opposite faces of said disc confined between them, and
   3. an indentation deformed within the blade at said location, defining a strip that is elongated transversely of the blade and has a curvature along its length which is less than that of the remainder of the blade and such as to be closely receivable in one of said slots in the disc;

C. edgewise inserting each blade into its slot in said disc, with said abutments at said location engaging opposite faces of the disc to confine the blade against lengthwise displacement relative to the disc; and D. edgewise deforming each tab to bring its nose portion into the bay of its adjacent slot and thus permanently confine the blade against edgewise displacement relative to the disc.

4. The method of claim 3, further characterized by:

so forming the blade that said curvature of said strip is such, in relation to the curvature and spacing of said longer and shorter edges of the slot, that said strip is received in the slot under flexing bias whereby the strip reacts against each said edge to maintain itself engaged against the opposing edge.

5. The method of making a blower rotor of the type comprising at least one sheet metal disc and a plurality of elongated blades which are secured to the disc at circumferentially spaced intervals around it and extend lengthwise parallel to its axis, said method comprising:

A. forming the disc with
   1. a plurality of circumferentially equispaced slots, one for each blade, each opening unrestrictedly to the periphery of the disc,
      a. each slot being defined in substantial part by opposing, elongated edges on the disc that are substantially straight and parallel to one another, and b. each slot having a bay at one side thereof, near its mouth and opening to the other side of the slot, said bay being defined in part by a substantially straight short edge on the disc that intersects the disc periphery and faces obliquely into the slot, and 2. a plurality of radially outwardly projecting tabs on the periphery of the disc, one adjacent to each slot, at said other side thereof, each of said tabs having a nose which is defined at least in part by a radially outer edge on the tab and by another edge thereon which is substantially straight and which extends outwardly from the mouth of the slot substantially parallel to the length of the slot;

B. forming each blade with 1. a substantial curvature across its width that is uniform along most of the length of the blade, and 2. an indentation deformed within the blade at the location along the length of the blade at which the blade is to engage said disc, said indentation defining a strip which is elongated transversely of the blade and has a profile along its length such that it is closely receivable between said opposing elongated edges of a slot, said indentation also providing opposing abutments on the blade that are spaced apart by a distance substantially equal to the thickness of the disc;

C. edgewise inserting each blade into its slot in said disc, with said abutments at each of said locations engaging opposite faces of the disc to confine the blade against lengthwise displacement relative to the disc; and D. edgewise deforming each tab across the mouth of its adjacent slot to engage a portion thereof against said substantially straight short edge on the disc, to thus lock the deformed tab against displacement out of the mouth of the slot and enable it to permanently secure the blade against edgewise displacement out of the slot.

6. The method of making a blower rotor of the type comprising at least one sheet metal disc and a plurality of elongated blades which are secured to the disc at circumferentially spaced intervals around it and extend lengthwise parallel to its axis, which method comprises:

A. forming each blade 1. with a substantial curvature across its width that is uniform along most of the length of the blade, 2. with an indentation deformed within the blade at the location along the length of the blade where the blade is to be secured to said disc, said indentation defining a. a strip which is elongated transversely of the blade, has a width (as measured lengthwise of the blade) that is substantially equal to the thickness of the disc, and has a curvature along its length which is substantially less than said curvature of most of the blade, and b. opposing abutments adjacent to the strip and at opposite sides thereof, to engage opposite faces of the disc, said abutments being defined by the offset relationship of the surfaces of the strip to those of adjacent portions of the blade;

B. forming said disc with a plurality of circumferentially equispaced slots that open unrestrictedly to the periphery of the disc, there being one such slot for each blade, a major portion of each slot that extends from its inner end being defined by a pair of opposite substantially straight edges on the disc that are spaced apart by a uniform distance along their lengths, said distance being such that one of said strips on a blade is receivable between said edges with a close fit, and no portion of said slot being narrower than the spacing between said edges;

C. inserting each blade edgewise into a slot in said disc, with one of said strips of the blade received between said edges of the slot and with said abutments engaging opposite faces of the disc to thus confine the blade against displacement relative to the disc in directions transverse to the blade surfaces and the disc surfaces; and D. edgewise deforming a peripheral portion of the disc adjacent to the mouth of each slot in a direction to close the mouth of the slot and thus confine the blade against edgewise displacement relative to the disc.

7. The method of claim 6, further characterized by:

so forming said disc as to provide the same with a tab that projects radially outwardly from the disc periphery adjacent to the mouth of each slot, at one side of the slot, said tab comprising the portion of the disc that is edgewise deformed to close the mouth of the slot.

8. The method of claim 7, further characterized by:

1. so forming said disc that a. one of said edges of each slot is aligned and continuous with a substantially straight edge on the tab adjacent to the slot, b. each said tab has a nose defined by its said substantially straight edge and by a radially outer edge of the tab, and c. the other of said edges of the slot extends outwardly to a bay in the slot, near the mouth thereof, that opens toward the first mentioned edge of the slot, said bay being defined in part by a portion of said other edge which faces obliquely into the slot; and 2. so deforming each said tab that its said nose is received in the bay of its adjacent slot and is confined against radially outward displacement by said bay-defining edge portion.

9. The method of making a blower rotor of the type comprising at least one sheet metal disc and a plurality of elongated blades which are secured to the disc at circumferentially spaced intervals around it and extend lengthwise parallel to its axis, which method comprises;

A. forming each blade 1. with a substantial curvature across its width that is uniform along most of the length of the blade, 2. with an indentation deformed within the blade at the location along its length where the blade is to be secured to said disc, said indentation defining a. a strip which is elongated transversely of the blade and has a width (as measured lengthwise of the blade) that is substantially equal to the thickness of said disc, and b. opposing abutments adjacent to the strip and at opposite sides thereof, to engage opposite faces of the disc, said abutments being defined by the offset relationship of the surfaces of the strip to those of adjacent portions of the blade;

B. forming said disc with a plurality of circumferentially equispaced slots that open unrestrictedly to the periphery of the disc, there being one such slot for each blade, a major portion of each slot that extends from its inner end being defined by a pair of opposite edges on the disc that are spaced apart by a uniform distance along their lengths, said distance being such that one of said strips on a blade is receivable between said edges with a substantially close fit, and no portion of said slot being narrower than the spacing between said edges;

C. inserting each blade edgewise into a slot in said disc, with one of said strips of the blade received between said edges of the slot and with said abutments engaging opposite faces of the disc to thus confine the blade against displacement relative to the disc in directions transverse to the blade surfaces and the disc surfaces; and D. edgewise deforming a peripheral portion of the disc adjacent to the mouth of each slot in a direction to close the mouth of the slot and thus confine the blade against edgewise displacement relative to the disc.

10. The method of claim 1 whereby a blower rotor is made that comprises a plurality of axially spaced apart sheet metal discs that are bridged by each of said blades and wherein each of said discs is formed with said plurality of circumferentially spaced slots and each blade is formed with a plurality of said indentations, one for each disc, at spaced apart locations along its length at which it is to engage said discs, further characterized by:

1. holding said discs in coaxial spaced apart relation to one another and with their respective slots aligned; and
2. inserting each blade edgewise substantially simultaneously into a slot in each disc.

* * * * *